US010273784B2

(12) United States Patent
Winslow et al.

(10) Patent No.: US 10,273,784 B2
(45) Date of Patent: Apr. 30, 2019

(54) FLUID-DRIVEN POWER GENERATION UNIT FOR A DRILL STRING ASSEMBLY

(75) Inventors: Daniel Martin Winslow, Spring, TX (US); John Keith Savage, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 889 days.

(21) Appl. No.: 14/409,784

(22) PCT Filed: Jun. 20, 2012

(86) PCT No.: PCT/US2012/043288

§ 371 (c)(1),
(2), (4) Date: Oct. 2, 2015

(87) PCT Pub. No.: WO2013/191688

PCT Pub. Date: Dec. 27, 2013

(65) Prior Publication Data

US 2016/0017693 A1 Jan. 21, 2016

(51) Int. Cl.

| | |
|---|---|
| ***E21B 43/00*** | (2006.01) |
| ***E21B 4/04*** | (2006.01) |
| ***F03B 13/10*** | (2006.01) |
| ***E21B 7/00*** | (2006.01) |
| ***E21B 7/04*** | (2006.01) |
| ***E21B 7/06*** | (2006.01) |

(Continued)

(52) U.S. Cl.

CPC ..... *E21B 41/00* (2013.01); *E21B 4/16* (2013.01); *E21B 41/0085* (2013.01)

(58) Field of Classification Search

None

See application file for complete search history.

(56) References Cited

U.S. PATENT DOCUMENTS 3,811,519 A * 5/1974 Driver ..... E21B 7/068 175/73
RE29,526 E * 1/1978 Jeter ..... E21B 7/06 175/61

(Continued)

OTHER PUBLICATIONS

International Search Report dated Feb. 8, 2013 for PCT Application No. PCT/US2012/043288 filed on Jun. 20, 2012.

*Primary Examiner* — Matthew R Buck
*Assistant Examiner* — Douglas S Wood
(74) *Attorney, Agent, or Firm* — Chamberlain Hrdlicka

(57) ABSTRACT

Multi-functional fluid-driven power generation units, modular power generation units, and drilling systems with a power generation unit are presented herein. A power generation unit for powering one or more downhole tools in a drill string is disclosed. The power generation unit includes a housing that is configured to couple to a downhole portion of the drill string and receive at least a portion of fluid flowing through the drill string. The power generation unit also includes a fluid-driven motor assembly with a drive shaft configured to output rotational drive forces generated by the motor assembly. An electrical generator is operatively coupled to the drive shaft and configured to convert the rotational drive forces generated by the motor assembly into electrical power. In addition, a hydraulic pump is operatively coupled to the drive shaft and configured to convert the rotational drive forces generated by the motor assembly into hydraulic power.

19 Claims, 4 Drawing Sheets

(51) Int. Cl.
*E21B 41/00* (2006.01)
*E21B 4/16* (2006.01)

(56) References Cited

U.S. PATENT DOCUMENTS

| | | | | |
|---|---|---|---|---|
| 4,828,050 | A * | 5/1989 | Hashimoto | E21B 7/062 175/45 |
| 6,092,610 | A * | 7/2000 | Kosmala | E21B 4/20 175/27 |
| 6,857,484 | B1 | 2/2005 | Helms et al. | |
| 7,002,261 | B2 | 2/2006 | Cousins | |
| 7,138,156 | B1 * | 11/2006 | Myrick | G02B 5/285 427/10 |
| 7,234,543 | B2 * | 6/2007 | Schaaf | E21B 3/02 175/106 |
| 8,887,834 | B2 * | 11/2014 | Millet | E21B 17/04 175/61 |
| 2003/0132003 | A1 | 7/2003 | Arauz | |
| 2008/0047753 | A1 | 2/2008 | Hall et al. | |

* cited by examiner

FLUID-DRIVEN POWER GENERATION UNIT FOR A DRILL STRING ASSEMBLY

TECHNICAL FIELD

The present disclosure relates generally to the drilling of boreholes, for example, during hydrocarbon exploration and excavation. More particularly, the present disclosure relates to downhole power generators for drill string assemblies.

BACKGROUND

Boreholes, which are also commonly referred to as "wellbores" and "drill holes," are created for a variety of purposes, including exploratory drilling for locating underground deposits of different natural resources, mining operations for extracting such deposits, and construction projects for installing underground utilities. A common misconception is that all boreholes are vertically aligned with the drilling rig; however, many applications require the drilling of boreholes with vertically deviated and horizontal geometries. A well-known technique employed for drilling horizontal, vertically deviated, and other complex boreholes is directional drilling. Directional drilling is generally typified as a process of boring a hole which is characterized in that at least a portion of the course of the bore hole in the earth is in a direction other than strictly vertical—i.e., the axes make an angle with a vertical plane (known as "vertical deviation"), and are directed in an azimuth plane.

Conventional directional boring techniques traditionally operate from a boring device that pushes or steers a series of connected drill pipes with a directable drill bit at the distal end thereof to achieve the borehole geometry. In the exploration and recovery of subsurface hydrocarbon deposits, such as petroleum and natural gas, the directional borehole is typically drilled with a rotatable drill bit that is attached to one end of a bottom hole assembly or "BHA." A steerable BHA can include, for example, a positive displacement motor (PDM) or "mud motor," drill collars, reamers, shocks, and underreaming tools to enlarge the wellbore. A stabilizer may be attached to the BHA to control the bending of the BHA to direct the bit in the desired direction (inclination and azimuth). The BHA, in turn, is attached to the bottom of a tubing assembly, often comprising jointed pipe or relatively flexible "spoolable" tubing, also known as "coiled tubing." This directional drilling system—i.e., the operatively interconnected tubing, drill bit, and BHA—can be referred to as a "drill string." When jointed pipe is utilized in the drill string, the drill bit can be rotated by rotating the jointed pipe from the surface, through the operation of the mud motor contained in the BHA, or both. In contrast, drill strings which employ coiled tubing generally rotate the drill bit via the mud motor in the BHA.

Advances in drilling techniques and technology have produced various types of downhole tools that provide an assortment of enhanced drilling features, such as hole enlargement, steering feedback, torque reduction, BHA monitoring, borehole evaluation, and drag resistance improvement. A few examples of some such downhole tools can include rotary steerable tools, stabilizers, sensor assemblies, agitator tools, reamers, measurement-while-drilling (MWD) tools, etc. On the larger end of the spectrum, some electric motors are used for rotating the drill bit and some for operating downhole pumps to provide forward and reverse circulation of the drilling fluid.

With the installation of downhole tools comes a need for dependable and efficient power sources to drive and regulate the hardware. One conventional way to provide electricity to downhole hardware is via a power cable that transmits electrical current from the surface, downhole through the drill string, and to the tool. In some other assemblies, high-temperature high-capacity batteries have been used as a local source of power for downhole electrical devices. As an alternate means of power generation, fuel cells have been used which generate electricity from an electrochemical reaction between petroleum products in the drilling fluid and an oxidant in a cell. In addition, a variety of mud-driven electrical power generators have been devised for supplying electricity to downhole tools. Although many downhole tools are powered by electricity, there are various tools that are fluid-driven or mechanically-driven devices that cannot be powered by these prior art approaches.

SUMMARY

Aspects of the present disclosure are directed to multi-functional fluid-driven power generation units and modular power generation units that generate power by diverting a percentage of fluid flow from a main column of drilling fluid into a hydraulic motor, which converts the kinetic energy in the fluid flow into rotational mechanical energy. This rotational mechanical energy is used, in at least some embodiments, to drive a generator to generate electrical power, a pump to generate hydraulic power, and a mechanical device to generate mechanical power. Unlike its conventional counterparts, this power generation unit can regulate hydraulically actuated downhole tools, such as steering pistons and telemetry valves, mechanically actuated downhole tools, such as mechanical set packers and shut-off valves, as well as electrically driven tools, such as an onboard CPU, solenoids, rotary steerable motors, etc. In addition, modular power generation units can be mounted on an exterior surface of a drilling tool which allows for easier access for maintenance and surface configuration. Optionally, the power generation unit can be located on an exterior surface of a non-rotating housing of a rotary steerable unit, which helps to simplify the design of the tool by not requiring slip-ring devices for transmitting power.

Aspects of the present disclosure are directed to a power generation unit for powering one or more downhole tools in a drill string with fluid flowing therethrough. The power generation unit includes a housing that is configured to couple to a downhole portion of the drill string and receive at least a portion of the fluid flowing through the drill string. The power generation unit also includes a fluid-driven motor assembly with a drive shaft that is configured to output rotational drive forces generated by the motor assembly. An electrical generator is operatively coupled to the drive shaft and configured to convert the rotational drive forces generated by the motor assembly into electrical power. In addition, a hydraulic pump is operatively coupled to the drive shaft and configured to convert the rotational drive forces generated by the motor assembly into hydraulic power.

According to other aspects of the present disclosure, a modular power generation unit is presented for powering downhole devices in a drill string for drilling a borehole in an earth formation. The drill string has drilling fluid flowing downhole therethrough. The modular power generation unit includes an elongated tubular housing that is configured to couple to a downhole portion of the drill string. A fluid coupling is coupled to the housing and configured to direct only a diverted portion of the drilling fluid from the drill string into the housing. The modular power generation unit also includes a turbine motor assembly disposed within the housing. The turbine motor assembly includes a stator, a blade-bearing rotor disposed within the stator and configured to be rotated by the diverted portion of the drilling fluid, and a drive shaft coupled to the rotor and configured to output rotational drive forces generated by the turbine motor assembly. A magnetic coupling is disposed within the housing. An electrical generator is also disposed within the housing and is coupled to the drive shaft via the magnetic coupling. The electrical generator is configured to convert the rotational drive forces generated by the turbine motor assembly into electrical power. The modular power generation unit further comprises a step-down gear system that is disposed within the housing. A hydraulic pump is disposed within the housing and operatively coupled to the drive shaft via the step-down gear system. The hydraulic pump is configured to convert the rotational drive forces generated by the turbine motor assembly into hydraulic power.

A drilling system is also featured in accordance with aspects of this disclosure. The drilling system includes a drill-pipe string with drilling fluid flowing downhole therethrough. A rotatable drill bit is operatively coupled to a distal end of the drill-pipe string. A downhole tool is operatively coupled proximate to the distal end of the drill-pipe string. The drilling system also includes a power generation unit for powering one or more downhole tools. The power generation unit includes a housing that is coupled to an exterior surface of the downhole tool and configured to receive at least a portion of the drilling fluid flowing downhole through the drill-pipe string. The power generation unit also includes a fluid-driven motor assembly with a drive shaft configured to output rotational drive forces generated by the motor assembly. An electrical generator is operatively coupled to the drive shaft and configured to convert the rotational drive forces generated by the motor assembly into electrical power to power one or more electrically driven downhole tools. In addition, a hydraulic pump is operatively coupled to the drive shaft and configured to convert the rotational drive forces generated by the motor assembly into hydraulic power to power one or more hydraulically driven downhole tools.

The above summary is not intended to represent each embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of the exemplary embodiments and modes for carrying out the present invention when taken in connection with the accompanying drawings and appended claims.

Figure 1:
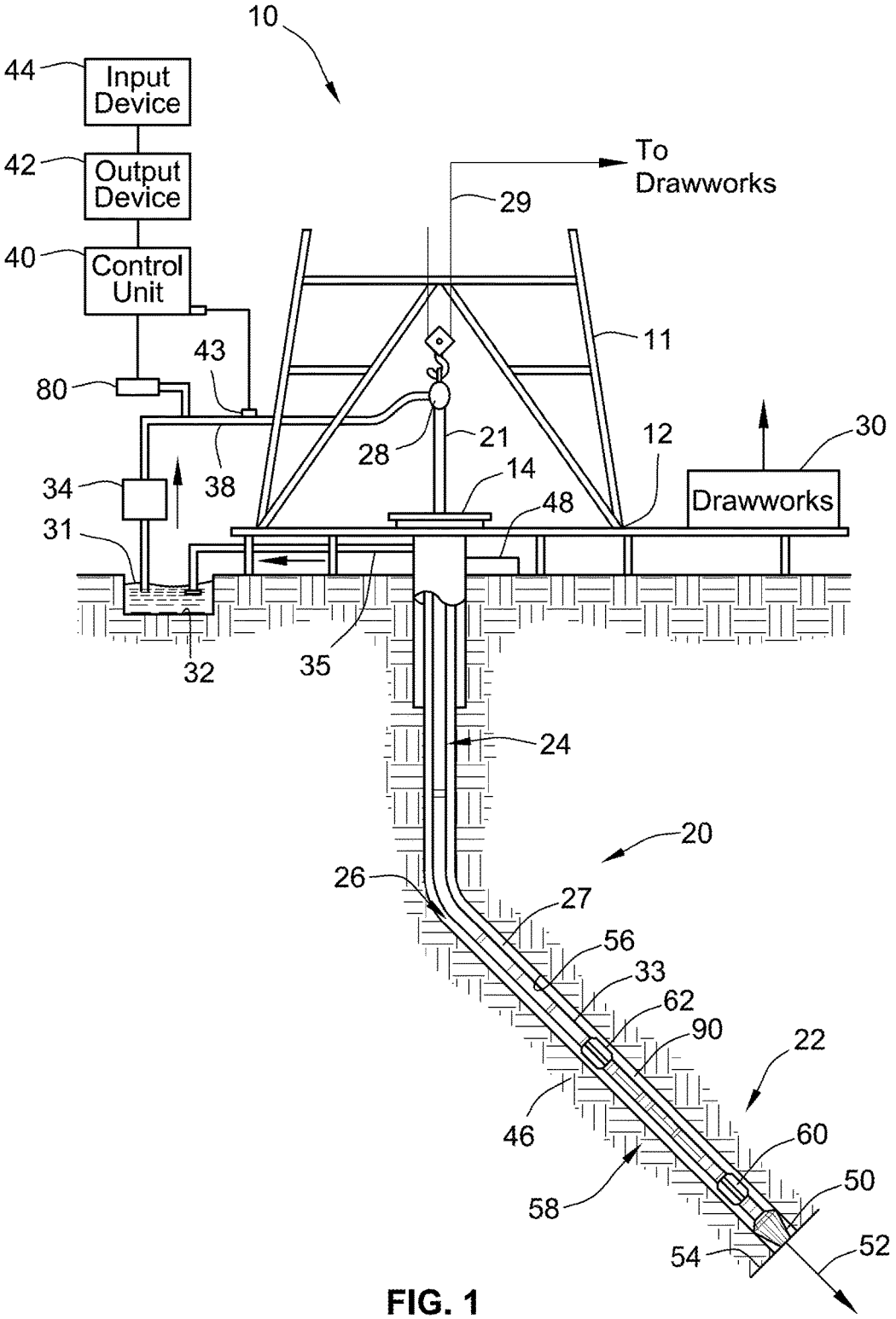
FIG. 1 is a schematic illustration of an exemplary drilling system in accordance with aspects of the present disclosure.

The present disclosure is susceptible to various modifications and alternative forms, and some representative embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION OF THE ILLUSTRATED EMBODIMENTS

While this invention is susceptible of embodiment in many different forms, there are shown in the drawings and will herein be described in detail representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed, the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring now to the drawings, wherein like reference numerals refer to like components throughout the several views, FIG. 1 illustrates an exemplary directional drilling system, designated generally as 10, in accordance with aspects of the present disclosure. Many of the disclosed concepts are discussed with reference to drilling operations for the exploration and/or recovery of subsurface hydrocarbon deposits, such as petroleum and natural gas. However, the disclosed concepts are not so limited, and can be applied to other drilling operations. To that end, the aspects of the present disclosure are not necessarily limited to the arrangement and components presented in FIGS. 1 and 2. For example, many of the features and aspects presented herein can be applied in horizontal drilling applications and vertical drilling applications without departing from the intended scope and spirit of the present disclosure. In addition, it should be understood that the drawings are not necessarily to scale and are provided purely for descriptive purposes; thus, the individual and relative dimensions and orientations presented in the drawings are not to be considered limiting.

The directional drilling system 10 exemplified in FIG. 1 includes a tower or "derrick" 11, as it is most commonly referred to in the art, that is buttressed by a derrick floor 12. The derrick floor 12 supports a rotary table 14 that is driven at a desired rotational speed, for example, via a chain drive system through operation of a prime mover (not shown). The rotary table 14, in turn, provides the necessary rotational force to a drill string 20. The drill string 20, which includes a drill pipe section 24, extends downwardly from the rotary table 14 into a directional borehole 26. As illustrated in the Figures, the borehole 26 may travel along a multi-dimensional path or "trajectory." The three-dimensional direction of the bottom 54 of the borehole 26 of FIG. 1 is represented by a pointing vector 52.

A drill bit 50 is attached to the distal, downhole end of the drill string 20. When rotated, e.g., via the rotary table 14, the drill bit 50 operates to break up and generally disintegrate the geological formation 46. The drill string 20 is coupled to a "drawworks" hoisting apparatus 30, for example, via a kelly joint 21, swivel 28, and line 29 through a pulley system (not shown). The drawworks 30 may comprise various components, including a drum, one or more motors, a reduction gear, a main brake, and an auxiliary brake. During a drilling operation, the drawworks 30 can be operated, in some embodiments, to control the weight on bit 50 and the rate of penetration of the drill string 20 into the borehole 26. The operation of drawworks 30 is generally known and is thus not described in detail herein.

During drilling operations, a suitable drilling fluid (commonly referred to in the art as "mud") 31 can be circulated, under pressure, out from a mud pit 32 and into the borehole 26 down through the drill string 20 by a hydraulic "mud pump" 34. The drilling fluid 31 may comprise, for example, water-based muds (WBM), which typically comprise a water-and-clay based composition, oil-based muds (OBM), where the base fluid is a petroleum product, such as diesel fuel, synthetic-based muds (SBM), where the base fluid is a synthetic oil, as well as gaseous drilling fluids. Drilling fluid 31 passes from the mud pump 34 into the drill string 20 via a fluid conduit (commonly referred to as a "mud line") 38 and the kelly joint 21. Drilling fluid 31 is discharged at the borehole bottom 54 through an opening or nozzle in the drill bit 50, and circulates in an "uphole" direction towards the surface through an annular space 27 between the drill string 20 and the side 56 of the borehole 26. As the drilling fluid 31 approaches the rotary table 14, it is discharged via a return line 35 into the mud pit 32. A variety of surface sensors 48, which are appropriately deployed on the surface of the borehole 26, operate alone or in conjunction with downhole sensors 70, 72 deployed within the borehole 26, to provide information about various drilling-related parameters, such as fluid flow rate, weight on bit, hook load, etc., which will be explained in further detail below.

A surface control unit 40 may receive signals from surface and downhole sensors and devices via a sensor or transducer 43, which can be placed on the fluid line 38. The surface control unit 40 can be operable to process such signals according to programmed instructions provided to surface control unit 40. Surface control unit 40 may present to an operator desired drilling parameters and other information via one or more output devices 42, such as a display, a computer monitor, speakers, lights, etc., which may be used by the operator to control the drilling operations. Surface control unit 40 may contain a computer, memory for storing data, a data recorder, and other known and hereinafter developed peripherals. Surface control unit 40 may also include models and may process data according to programmed instructions, and respond to user commands entered through a suitable input device 44, which may be in the nature of a keyboard, touchscreen, microphone, mouse, joystick, etc.

In some embodiments of the present disclosure, the rotatable drill bit 50 is attached at a distal end of a steerable drilling bottom hole assembly (BHA) 22. In the illustrated embodiment, the BHA 22 is coupled between the drill bit 50 and the drill pipe section 24 of the drill string 20. The BHA 22 may comprise a Measurement While Drilling (MWD) System, designated generally at 58 in FIG. 1, with various sensors to provide information about the formation 46 and downhole drilling parameters. The MWD sensors in the BHA 22 may include, but are not limited to, a device for measuring the formation resistivity near the drill bit, a gamma ray device for measuring the formation gamma ray intensity, devices for determining the inclination and azimuth of the drill string, and pressure sensors for measuring drilling fluid pressure downhole. The MWD may also include additional/alternative sensing devices for measuring shock, vibration, torque, telemetry, etc. The above-noted devices may transmit data to a downhole transmitter 33, which in turn transmits the data uphole to the surface control unit 40. In some embodiments, the BHA 22 may also include a Logging While Drilling (LWD) System.

In some embodiments, a mud pulse telemetry technique may be used to communicate data from downhole sensors and devices during drilling operations. Exemplary methods and apparatuses for mud pulse telemetry are described in U.S. Pat. No. 7,106,210 B2, to Christopher A. Golla et al. Other known methods of telemetry which may be used without departing from the intended scope of this disclosure include electromagnetic telemetry, acoustic telemetry, and wired drill pipe telemetry, among others.

A transducer 43 can be placed in the mud supply line 38 to detect the mud pulses responsive to the data transmitted by the downhole transmitter 33. The transducer 43 in turn generates electrical signals, for example, in response to the mud pressure variations and transmits such signals to the surface control unit 40. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. As illustrated in FIG. 1, a surface transmitter receiver 80 communicates with downhole tools using, for example, any of the transmission techniques described, such as a mud pulse telemetry technique. This can enable two-way communication between the surface control unit 40 and the downhole tools described below.

According to aspects of this disclosure, the BHA 22 can provide some or all of the requisite force for the bit 50 to break through the formation 46 (known as "weight on bit"), and provide the necessary directional control for drilling the borehole 26. In the embodiments illustrated in FIGS. 1 and 2, the BHA 22 may comprise a drilling motor 90 and first and second longitudinally spaced stabilizers 60 and 62. At least one of the stabilizers 60, 62 may be an adjustable stabilizer that is operable to assist in controlling the direction of the borehole 26. Optional radially adjustable stabilizers may be used in the BHA 22 of the steerable directional drilling system 10 to adjust the angle of the BHA 22 with respect to the axis of the borehole 26. A radially adjustable stabilizer provides a wider range of directional adjustability than is available with a conventional fixed diameter stabilizer. This adjustability may save substantial rig time by allowing the BHA 22 to be adjusted downhole instead of tripping out for changes. However, even a radially adjustable stabilizer provides only a limited range of directional adjustments. Additional information regarding adjustable stabilizers and their use in directional drilling systems can be found in U.S. Patent Application Publication No. 2011/0031023 A1, to Clive D. Menezes et al., which is entitled "Borehole Drilling Apparatus, Systems, and Methods".

Figure 2:
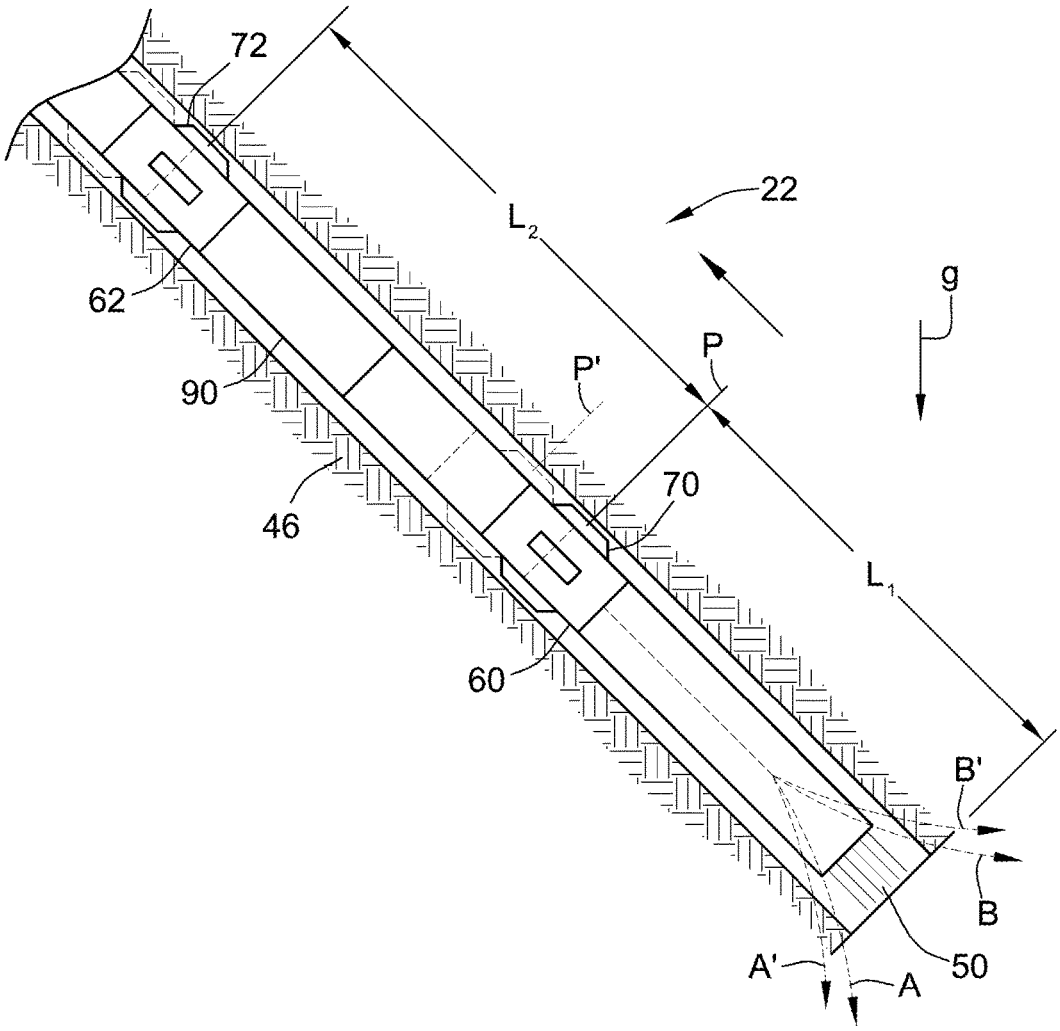
FIG. 2 is a schematic illustration of an exemplary bottom hole assembly (BHA) in accordance with aspects of the present disclosure.

As shown in the embodiment of FIG. 2, the distance between the drill bit 50 and the first stabilizer 60, designated as $L_1$, can be a factor in determining the bend characteristics of the BHA 22. Similarly, the distance between the first stabilizer 60 and the second stabilizer 62, designated as $L_2$, can be another factor in determining the bend characteristics of the BHA 22. The deflection at the drill bit 50 of the BHA 22 is a nonlinear function of the distance $L_1$, such that relatively small changes in $L_1$ may significantly alter the bending characteristics of the BHA 22. With radially movable stabilizer blades, a dropping or building angle, for example A or B, can be induced at bit 50 with the stabilizer at position P. By axially moving stabilizer 60 from P to P', the deflection at bit 50 can be increased from A to A' or B to B'. A stabilizer having both axial and radial adjustment may substantially extend the range of directional adjustment, thereby saving the time necessary to change out the BHA 22 to a different configuration. In some embodiments the stabilizer may be axially movable. The position and adjustment of the second stabilizer 62 adds additional flexibility in adjusting the BHA 22 to achieve the desired bend of the BHA 22 to achieve the desired borehole curvature and direction. As such, the second stabilizer 62 may have the same functionality as the first stabilizer 60. While shown in two dimensions, proper adjustment of stabilizer blades may also provide three dimensional turning of BHA 22.

Figure 3:
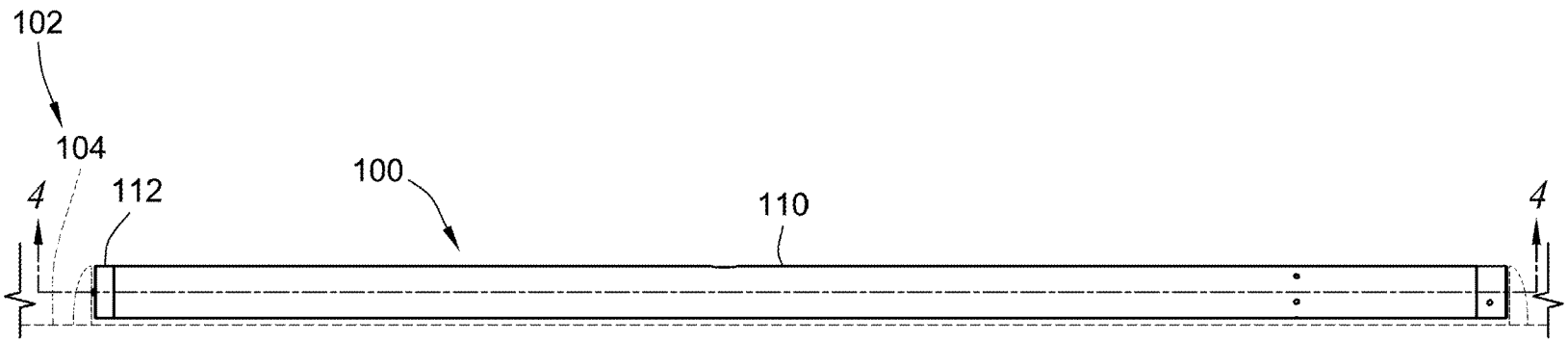
FIG. 3 is a side-view illustration of a representative power generation unit in accordance with aspects of the present disclosure.
Figure 4:
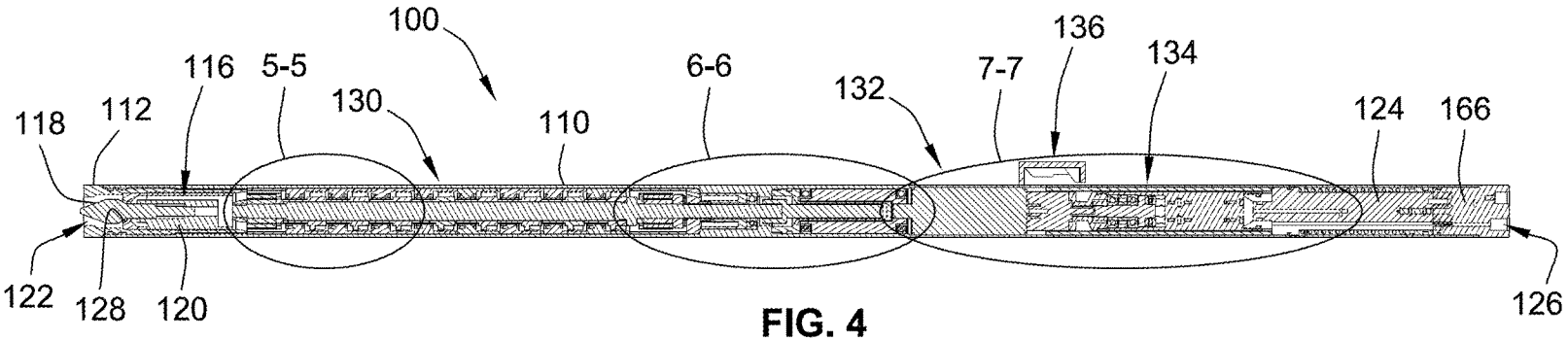
FIG. 4 is a cross-sectional plan-view illustration of the power generation unit of FIG. 3 taken along line 4-4.

FIGS. 3 and 4 illustrate a representative power generation unit, designated generally at 100, for powering one or more downhole tools in a drill string 102 of the type used for drilling a borehole in an earth formation, such as drilling system 10 of FIG. 1. The drill string system 102 to which the power generation unit 100 is operatively coupled can take on various forms, optional configurations, and functional alternatives, some of which are described above with respect to the directional drilling system 10 exemplified in FIGS. 1 and 2. By way of non-limiting example, the drill string system 102 can include a drill-pipe string, such as drill pipe section 24, through which drilling fluid (e.g., mud 31) is circulated downhole, under pressure, into a borehole by mud pump 34 of FIG. 1. A rotatable drill bit, such as drill bit 50, is operatively coupled to a distal end of the drill-pipe string (e.g., projecting from BHA 22). One or more downhole tools, such as MWD system 58, stabilizers 60 and 62, downhole sensors 70 and 72, drilling motor 90, etc., are operatively coupled proximate to the distal end of the drill-pipe string. Only selected components of the drill string system 102 have been shown and will be described in additional detail below. Nevertheless, the drill string systems discussed herein can include numerous additional, alternative, and other well-known peripheral components without departing from the intended scope and spirit of the present disclosure. Seeing as these components are well known in the art, they will not be described in further detail. It is also envisioned that the power generation unit 100 can be integrated into vertical drilling systems, horizontal drilling systems, and other types of directional (steerable and non-steerable) drilling systems.

The power generation unit 100 includes an elongated, generally cylindrical, tubular housing 110 that is configured to couple to a downhole portion 104 of a drill string 102 to receive at least a portion, and in some embodiments only a regulated or "diverted" portion, of the drilling fluid flowing downhole through the drill string 102. In at least some configurations, the power generation unit 100 is "modular"—e.g., a substantially or completely self-contained unit that can be readily interchanged with other like-configured units. As shown, the only external features that may be required for full functionality of the downhole power generation unit 100 is power conditioning of generator output and output connectivity for transmitting power to the downhole tools. Moreover, the power generation unit 100 can be mounted on an interior or, in some preferred embodiments, an exterior surface of a drilling tool, such as a collar. Mounting the power generation unit 100 to an exterior surface of a downhole portion of the drill string 102 allows for easier access to the unit 100, for example, for installation, maintenance, replacement and configuration, which in turn reduces downtime, overhead, and labor time and costs. Optionally, the power generation unit 100 can be located on an exterior surface of a non-rotating housing of a rotary steerable tool, which eliminates the need for slip-ring devices for transmitting power from the unit 100 to the downhole tools.

The power generation unit 100 portrayed in FIGS. 3 and 4 includes a first fluid coupling 112 coupled to a first longitudinal end of the housing 110, and a second fluid coupling (not shown) may be coupled to a middle section of the housing 110. The first fluid coupling 112 fluidly couples the housing 110 to the drill string 102 and operates to divert and/or direct into the housing 110 at least a portion of the drilling fluid from the main fluid flow (or "column") passing down through the drill string 102. Comparatively, the second fluid coupling is configured to direct fluid out of the housing 110, e.g., back into the main fluid column in the drill string 102 or into the annular space between the drill string 102 and the side of the borehole. In at least some embodiments, the second fluid coupling is located at the end of the turbine section, which will be discussed in detail below. The first fluid coupling 112 may also be configured to regulate the rate of flow of the fluid into the housing 110 such that only a regulated or "diverted" portion of the drilling fluid is redirected into the housing 110. In the illustrated embodiment, the first fluid coupling 112 includes an electrically actuated poppet-type check valve assembly 116 with a frusta-conical plug 118 that is selectively moved rectilinearly back-and-forth by a solenoid 120 to obstruct a seat 128 and thereby control the timing, rate of flow, and/or quantity of fluid received in the housing 110. In addition, a hydraulic manifold 124, which is located at a second longitudinal end of the of the housing 110, is configured to regulate the flow of fluid as it exits the housing 110 through a fluid outlet port 126.

In some embodiments, the power generation unit 100 of FIG. 3 is operable to power at least one downhole tool, while in some embodiments the unit 100 is operable to power at least two downhole tools, and yet in other embodiments the unit 100 is operable to power three or more downhole tools. These downhole tools may include, in various combinations, one or more hydraulically powered/actuated downhole tools, one or more electrically powered/actuated downhole tools, and one or more mechanically powered/actuated downhole tools. The downhole power generation unit 100 could be used to power, for example, resistivity measurement tools, density measurement tools, porosity measurement tools, acoustic measurement tools, natural gamma tools, position measurement tools, etc. The power generation unit 100 could also be used to power many types of telemetry systems, such as a mud pulse telemetry, acoustic telemetry, or electro-magnetic telemetry, as well as to power steering devices used to control the direction of the well.

As noted above, the elongated tubular body of the housing 110 has a fluid inlet 122 at a first longitudinal end of the housing 110 and a fluid outlet 126 at a second longitudinal end opposite the first longitudinal end. Disposed inside the housing 110 in order from the inlet to the outlet 122, 126 (left-to-right in FIG. 4) is: the check valve assembly 116; a fluid-driven motor assembly 130 adjacent the check valve assembly 116 and proximal the fluid inlet 122; an electrical generator 132 adjacent to and fluidly downstream from the motor assembly 130; and, a hydraulic pump 134 downstream from the electrical generator 132 and proximal the fluid outlet 126. As will be developed in further detail below, the power generation unit 100 may further comprise a mechanical transmission 136 attached to or integrated within the housing 110 between the electrical generator 132 and the hydraulic pump 134. Moreover, a magnetic coupling 150 may be disposed downstream from the motor assembly 130 to couple the motor assembly 130 to the electrical generator 132.

Figure 5:
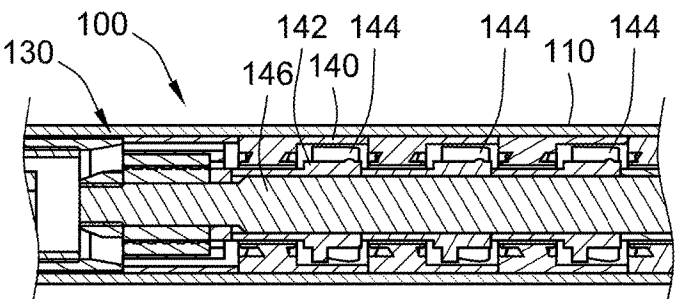
FIG. 5 is a cross-sectional plan-view illustration of a first portion of the modular power generation unit of FIG. 3 which is generally designated at 5-5 in FIG. 4.

A representative example of a fluid-driven motor assembly 130 for the power generation unit 100 is described with respect to the configuration depicted in FIG. 5. In this illustrated embodiment, the fluid-driven motor assembly 130 is a turbine motor assembly with a multi-bladed (or, alternatively, multi-lobed) stator 140 with a rotatable blade-bearing rotor 142 disposed inside the stator 140. Pressurized drilling fluid that is bypassed into the power generation unit 100 through the fluid inlet port 122 and passed into the internal passage between the stator 140 and the rotor 142 imparts a force on the angled rotor blades 144 causing the rotor 142 to rotate within the stator 140. A drive shaft 146 coupled to the rotor 142 is configured to output the rotational drive forces generated by the turbine motor assembly 130 of FIG. 5. The drive shaft 146 is rotatably connected to the housing 110 via a roller bearing 160 (see FIG. 6). Multiple devices and accessories can be operatively coupled to the drive shaft 146 to receive driving forces therefrom, as will become more evident from the discussion below.

Some advantages of using a turbine-driven motor include the overall simplicity of its design and the ability to package a turbine motor in a wider variety of locations. In addition, the turbine motor can operate at higher temperatures and output at higher speeds than many of its conventional counterparts. The high-speed output of a turbine motor allows for an overall reduction in the size of the generator. In alternative embodiments, the power generation unit 100 may further include, or the turbine motor 130 may be replaced by, other fluid-driven motor arrangements, such as a positive displacement motor (PDM), without departing from the intended scope and spirit of the present disclosure. Several non-limiting examples of hydraulic motors that may be used include progressive cavity motors, twin screw motors, helical gear motors, gerotor motors, axial piston motors, and vane motors. Another type of kinetic motor that could be used, in addition to the turbine motor 130 described above, is an impeller-based motor design where the fluid changes directions off the turbine/stator vane.

Figure 6:
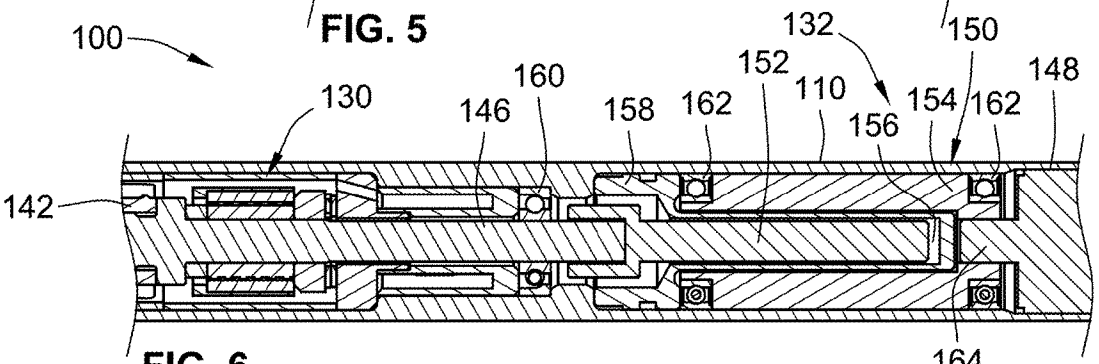
FIG. 6 is a cross-sectional plan-view illustration of a second portion of the modular power generation unit of FIG. 3 which is generally designated at 6-6 in FIG. 4.

Turning to FIG. 6, rotational drive forces generated by the motor assembly 130 are transmitted via the drive shaft 146 to the electrical generator 132, which is configured to convert this rotational power into electrical power to drive various electrically powered downhole tools. The electrical generator 132 includes a single-phase or multi-phase (e.g., 3-phase) permanent magnet alternator 148 that is coupled to the drive shaft 146 via a magnetic coupling 150. According to the embodiment illustrated in FIG. 6, the magnetic coupling 150 comprises a magnetically charged rotor 152 that is rotatably disposed inside a magnetically charged annulus 154. The rotor 152 and annulus 154 may be fabricated from high-temperature high-strength magnets, such as samarium cobalt magnets. A pair of radial bearings 162, which may be in the nature of polycrystalline diamond compact (PDC) bearings, rotatably mounts the annulus 154 to the inside of the housing 110. The magnetically charged rotor 152 is coupled (e.g., splined or keyed) to the drive shaft 146, while the annulus 154 is coupled (e.g., splined or keyed) to a generator drive shaft 164. In the embodiment illustrated, the rotor 152 is separated from the annulus 154 via a barrier, which includes a lubricating fluid 156 and an elongated tubular liner 158 which sheaths the rotor 152.

The motor assembly 130 transmits rotational drive forces through the drive shaft 146 to the magnetically charged rotor 152, which causes the rotor 152 to spin. The magnetic field of the rotating magnetically charged rotor 152 forces the annulus 154 to spin, which in turn rotates the generator drive shaft 164. By rotating the generator drive shaft 164, the electromechanical alternator 148 creates an alternating magnetic field that induces an alternating voltage across an internal cluster of stator windings, thereby converting the mechanical power of the motor assembly 130 into electrical energy in the form of alternating current. An electrical conduit 166 (FIG. 4) then transmits the electrical power generated by the electrical generator 132 to one or more electrically powered downhole tools in the drill string 102. In an alternative configuration, a direct mechanical coupling, which incorporates a rotary seal to separate out the drilling fluid from the clean hydraulic fluid, could be used to couple the drive shaft 146 directly to the generator 132. Nevertheless, in some preferred embodiments, the magnetic coupling 150 may be desirable since rotary seals can be prone to failure.

Packaged downstream from the generator 148 is a hydraulic pump 134 that is also operatively coupled to the drive shaft 146, but is configured to convert the rotational power generated by the motor assembly 130 into hydraulic power to drive various hydraulically powered downhole tools. By way of example, and not limitation, the hydraulic pump 134 of FIG. 7 includes a plurality of circumferentially spaced spring-biased pistons 168 that are coupled via thrust bearings 172 to a nutating swash plate 170. A pair of radial bearings 176 circumscribes an integrally formed center shaft 178 of the swash plate 170 to rotatably mount the swash plate 170 to a pump housing 174. Operatively attaching the hydraulic pump 134 to the drive shaft 146 is a step-down gear system 180. The step-down gear system 180 comprises a gearbox 182 that is mechanically coupled to the generator drive shaft 164, which is connected to the motor drive shaft 146 via the magnetic coupling 150 in the manner described above. In some embodiments, the gearbox 182 houses a planetary gear set that is configured to reduce the rotational velocity of the rotational drive forces transmitted from the fluid-driven motor assembly 130 to the hydraulic pump 134. The gearbox 182 is mechanically coupled to the pump housing 174 via a toroidal coupling 184, while the planetary gear set is coupled to the center shaft 178 of the swash plate 170 via splined engagement with a gearbox output shaft 190. A biasing member, represented in the drawings as a helical spring 192, presses the hydraulic manifold 124 against the hydraulic pump 134 and thereby biases the motor assembly 130, electrical generator 132, and hydraulic pump 134 in an upstream direction (to the left in FIG. 4) toward the fluid inlet 122.

The rotational drive forces generated by the motor assembly 130 are transmitted through the gearbox 182 to rotate the swash plate 170. Rotation of the angled swash plate 170 forces the pistons 168 to reciprocate back-and-forth inside ports 186 formed in the pump housing 174. These ports allow the reciprocating pistons 168 to draw in fluid as they move toward the swash plate 170 and discharge fluid as they move away from the swash plate 170. This interplay converts the rotational power of the motor assembly 130 into hydraulic power. A hydraulic conduit 188 transmits the hydraulic power generated by the hydraulic pump 134 (e.g., as pressurized fluid) to one or more hydraulically powered downhole tools, like telemetry tools and steering tools. Most hydraulically actuated downhole tools require clean hydraulic fluid, for example, due to the size of the hydraulic components, and thus cannot use the drilling fluid flowing downhole in the main column. In addition, many hydraulic tools require operating pressures that are higher than the dynamic pressure of the drilling fluid (e.g., dynamic drilling fluid pressure ~500 psi vs. operating pressure ~5,000 psi). The hydraulic pump 134 is able to provide the increased hydraulic pressures and cleaner hydraulic fluid required by these downhole tools.

Figure 7:
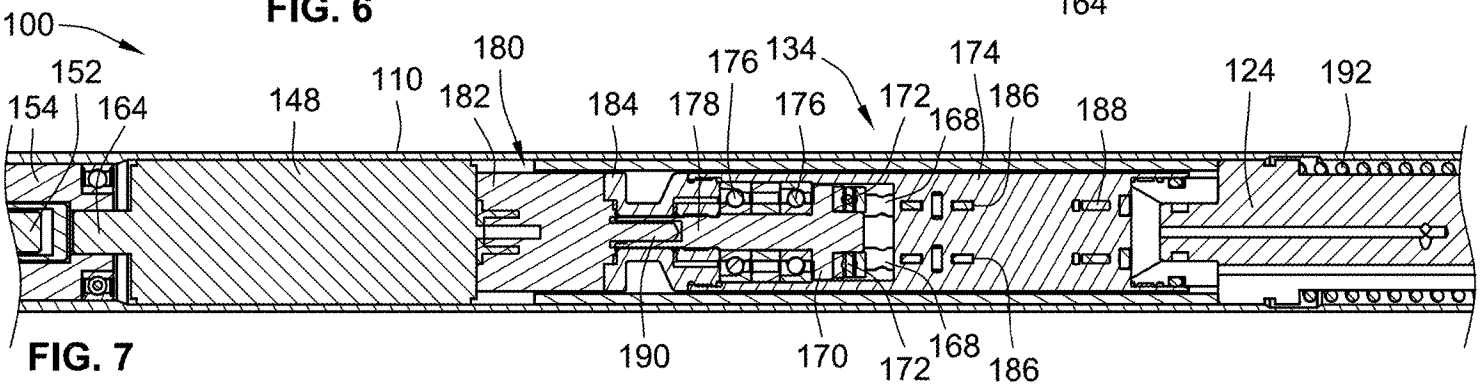
FIG. 7 is a cross-sectional plan-view illustration of a third portion of the modular power generation unit of FIG. 3 which is generally designated at 7-7 in FIG. 4.

With reference back to FIG. 4, a mechanical transmission 136 is operatively coupled to the drive shaft 146 of the fluid-driven motor assembly 130, and configured to transmit rotational power generated by the motor assembly 130 to one or more mechanically driven downhole tools. In the illustrated embodiment, the mechanical transmission 136 is a gear train coupled to the outer periphery of the housing 110. As shown, the mechanical transmission 136 is connected to the drive shaft 146 via the gearbox 182 (FIG. 7). In alternative embodiments, the mechanical transmission 136 could be attached directly to the drive shaft 164. Moreover, the mechanical transmission 136 could be packaged inside the housing 110, and could take on numerous alternative forms, such as a chain drive or belt drive.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A power generation unit for powering one or more downhole tools in a drill string with fluid flowing therethrough, the power generation unit comprising:

a housing configured to couple to a downhole portion of the drill string and receive at least a portion of the fluid flowing through the drill string;

a fluid-driven motor assembly with a drive shaft configured to output rotational drive forces generated by the motor assembly;

an electrical generator operatively coupled to the drive shaft and configured to convert the rotational drive forces generated by the motor assembly into electrical power; and a hydraulic pump operatively coupled to the drive shaft using a step-down gear system and configured to convert the rotational drive forces generated by the motor assembly into hydraulic power, wherein the electrical generator and the hydraulic pump are concurrently operatively coupled to the drive shaft.

2. The power generation unit of claim 1, further comprising a mechanical transmission operatively coupled to the drive shaft and configured to transmit the rotational drive forces generated by the motor assembly to a mechanically driven downhole tool.

3. The power generation unit of claim 1, further comprising a magnetic coupling connecting the electrical generator to the drive shaft.

4. The power generation unit of claim 3, wherein the magnetic coupling includes a magnetically charged rotor rotatably disposed inside a magnetically charged annulus.

5. The power generation unit of claim 1, wherein the step-down gear system comprises a planetary gear set housed inside a gearbox.

6. The power generation unit of claim 1, further comprising a fluid coupling coupled to a first end of the housing and configured to direct the at least a portion of the fluid from the drill string into the housing.

7. The power generation unit of claim 6, wherein the fluid coupling is configured to regulate a rate of flow of the fluid received by the housing.

8. The power generation unit of claim 1, wherein the electrical generator includes a multi-phase alternator.

9. The power generation unit of claim 1, wherein the hydraulic pump includes one or more pistons operatively coupled to a swash plate, the rotational drive forces generated by the motor assembly rotating the swash plate, and the rotation of the swash plate actuating the one or more pistons to thereby convert the rotational drive forces into hydraulic power.

10. The power generation unit of claim 1, further comprising a biasing member configured to bias the motor assembly, the electrical generator, and the hydraulic pump in an upstream direction.

11. The power generation unit of claim 1, wherein the housing includes an elongated tubular body with a fluid inlet and a fluid outlet, wherein the motor assembly is disposed inside the housing proximal the fluid inlet, the electrical generator is disposed inside the housing downstream from the motor assembly, and the hydraulic pump is disposed inside the housing downstream from the electrical generator.

12. The power generation unit of claim 1, further comprising an electrical conduit configured to transmit the electrical power generated by the electrical generator to an electrically powered downhole tool, and a hydraulic conduit configured to transmit the hydraulic power generated by the hydraulic pump to a hydraulically powered downhole tool.

13. A modular power generation unit for powering downhole tools of a drill string for drilling a borehole in an earth formation, the drill string having drilling fluid flowing downhole therethrough, the modular power generation unit comprising:

an elongated tubular housing configured to couple to a downhole portion of the drill string;

a fluid coupling coupled to the housing and configured to direct only a diverted portion of the drilling fluid from the drill string into the housing;

a turbine motor assembly disposed within the housing, the turbine motor assembly including a stator, a blade-bearing rotor disposed within the stator and configured to be rotated by the diverted portion of the drilling fluid, and a drive shaft coupled to the rotor and configured to output rotational drive forces generated by the turbine motor assembly;

a magnetic coupling disposed within the housing;

an electrical generator disposed within the housing and coupled to the drive shaft via the magnetic coupling, the electrical generator being configured to convert the rotational drive forces generated by the turbine motor assembly into electrical power;

a step-down gear system disposed within the housing; and a hydraulic pump disposed within the housing and operatively coupled to the drive shaft via the step-down gear system, the hydraulic pump being configured to convert the rotational drive forces generated by the turbine motor assembly into hydraulic power, wherein the electrical generator and the hydraulic pump are concurrently operatively coupled to the drive shaft.

14. The modular power generation unit of claim 13, further comprising a mechanical transmission coupled to the step-down gear system and configured to transmit the rotational drive forces generated by the turbine motor assembly to a mechanically driven downhole tool.

15. The modular power generation unit of claim 13, further comprising an electrical conduit configured to transmit the electrical power generated by the electrical generator to an electrically powered downhole tool, and a hydraulic conduit configured to transmit the hydraulic power generated by the hydraulic pump to a hydraulically powered downhole tool.

16. The modular power generation unit of claim 13, wherein the magnetic coupling includes a magnetically charged rotor coupled to the drive shaft and a magnetically charged annulus coupled to the electrical generator, the magnetically charged rotor being rotatably disposed inside the annulus and separated from the annulus via a barrier.

17. The modular power generation of claim 13, wherein the step-down gear system comprises a gearbox within which is disposed a planetary gear set configured to reduce the rotational velocity of the rotational drive forces transmitted to the hydraulic pump.

18. The modular power generation of claim 13, wherein the fluid coupling is configured to regulate the rate of flow of the drilling fluid into the housing.

19. A drilling system comprising:

a drill-pipe string with drilling fluid flowing downhole therethrough; a rotatable drill bit operatively coupled to a distal end of the drill-pipe string;

a downhole tool operatively coupled proximate to the distal end of the drill-pipe string, the downhole tool having an exterior surface;

a fluid-driven motor assembly with a drive shaft configured to output rotational drive forces generated by the motor assembly;

a drill bit operatively coupled to the drive shaft; and a power generation unit for powering one or more downhole tools, the power generation unit independent of the drive shaft and including:

a housing coupled to or disposed within the downhole tool and configured to receive at least a portion of the drilling fluid flowing downhole through the drill-pipe string;

a power generation fluid-driven motor assembly with a power generation drive shaft configured to output rotational drive forces generated by the power generation motor assembly;

an electrical generator operatively coupled to the power generation drive shaft and configured to convert the rotational drive forces generated by the power generation motor assembly into electrical power to power an electrically driven downhole tool; and a hydraulic pump operatively coupled to the power generation drive shaft and configured to convert the rotational drive forces generated by the power generation motor assembly into hydraulic power to power a hydraulically driven downhole tool, wherein the electrical generator and the hydraulic pump are concurrently operatively coupled to the power generation drive shaft.

* * * * *